US009745795B2

(12) United States Patent
Su

(10) Patent No.: US 9,745,795 B2
(45) Date of Patent: Aug. 29, 2017

(54) INFLATABLE FLOOD BARRIER

(71) Applicant: NAN DAO ENGINEERING CORP., New Taipei (TW)

(72) Inventor: Allen Su, New Taipei (TW)

(73) Assignee: NAN DAO ENGINEERING CORP., New Taipei (TW)

( * ) Notice: Subject to any disclaimer, the term of this patent is extended or adjusted under 35 U.S.C. 154(b) by 366 days.

(21) Appl. No.: 14/459,969

(22) Filed: Aug. 14, 2014

(65) Prior Publication Data

US 2016/0047102 A1 Feb. 18, 2016

(51) Int. Cl.

| | |
|---|---|
| ***E02B 7/00*** | (2006.01) |
| ***E02B 7/28*** | (2006.01) |
| ***E02B 7/30*** | (2006.01) |
| ***E06B 7/23*** | (2006.01) |
| ***E06B 9/02*** | (2006.01) |
| *E06B 9/00* | (2006.01) |

(52) U.S. Cl.

CPC ..... *E06B 7/2318* (2013.01); *E06B 9/02* (2013.01); *E06B 2009/007* (2013.01)

(58) Field of Classification Search

CPC ... E02B 7/00; E02B 7/205; E02B 7/28; E02B 7/26; E02B 7/30; E02B 7/36; E02B 7/40; E02B 3/10

USPC ..... 405/87, 92, 93, 103, 104; 52/302.1, 52/741.3; 160/126, 330; 454/275

See application file for complete search history.

(56) References Cited

U.S. PATENT DOCUMENTS

| | | | | | |
|---|---|---|---|---|---|
| 635,206 | A * | 10/1899 | Taylor | E02B 7/205 | 405/100 |
| 850,441 | A * | 4/1907 | McGinnis | E02B 7/205 | 292/200 |
| 1,516,833 | A * | 11/1924 | Shipp | F24F 7/00 | 454/273 |
| 1,681,134 | A * | 8/1928 | Ruth | E06B 7/232 | 49/496.1 |
| 2,105,735 | A * | 1/1938 | Hodge | B65D 90/34 | 292/265 |
| 2,159,735 | A * | 5/1939 | Gast | A01G 9/14 | 52/302.1 |
| 2,565,122 | A * | 8/1951 | Cowan | E04C 1/42 | 454/273 |
| 2,611,310 | A * | 9/1952 | Cowan | E04C 1/42 | 454/273 |

(Continued)

*Primary Examiner* — Benjamin Fiorello
*Assistant Examiner* — Edwin Toledo-Duran
(74) *Attorney, Agent, or Firm* — Muncy, Geissler, Olds & Lowe, P.C.

(57) ABSTRACT

An inflatable flood barrier includes a board having a side plate and a peripheral plate attached to the side plate. The board being provided with a charging port, the peripheral plate has rounded corners, and the side plate has corner portions. The rounded corners and the corner portions are positionally corresponding. The corner portion has guiding grooves. A flexible seal embraces at least a part of the peripheral plate and has an internal channel, a gas inlet and a gas discharging port. When the flexible seal is inflated at the internal channel, a watertight combination between the inflatable flood barrier and a contacting surface of a gate it protects is achieved. The inflatable flood barrier is structurally simple, watertight, convenient to use and store, apparently pleasing, and functionally versatile.

10 Claims, 8 Drawing Sheets

(56) References Cited

U.S. PATENT DOCUMENTS 2,709,402 A * 5/1955 Malm ..... E06B 7/02 454/271
2,754,747 A * 7/1956 Bertling ..... F24F 13/075 454/309
2,758,646 A * 8/1956 Johnson ..... E06B 7/32 160/123
2,774,116 A * 12/1956 Wolverton ..... E06B 7/28 137/493.1
2,839,791 A * 6/1958 Lee ..... E06B 7/32 16/225
2,840,867 A * 7/1958 Wilder ..... E04B 1/7076 29/282
3,001,332 A * 9/1961 Wilder ..... E04B 1/7076 227/68
3,252,576 A * 5/1966 Miller ..... E04H 4/1209 137/101.27
3,796,010 A * 3/1974 Carlson ..... E06B 7/2318 405/106
3,797,554 A * 3/1974 Johnson ..... E06B 7/32 160/354
4,053,007 A * 10/1977 Griffith ..... E06B 7/32 160/180
4,116,213 A * 9/1978 Kamezaki ..... F24F 11/043 137/360
4,173,099 A * 11/1979 Robb ..... E06B 7/32 49/168
4,399,771 A * 8/1983 Medley ..... E06B 7/32 119/501
4,480,407 A * 11/1984 Needham ..... E06B 7/32 49/168
4,669,371 A * 6/1987 Sarazen, Jr. ..... F24F 13/00 248/27.3
4,683,692 A * 8/1987 Tetschner ..... E04B 1/78 52/169.11
4,754,696 A * 7/1988 Sarazen ..... F24F 13/15 236/49.5
5,269,097 A * 12/1993 Davlantes ..... A01K 1/035 49/169
5,287,654 A * 2/1994 Davlantes ..... A01K 1/035 47/56
5,444,947 A * 8/1995 Miller ..... E04B 1/7076 249/39
5,460,572 A * 10/1995 Waltz ..... F24F 13/08 454/271
5,487,701 A * 1/1996 Schedegger ..... F24F 13/08 454/271
5,642,534 A * 7/1997 Sanchez ..... E04H 4/1218 210/167.12
5,657,592 A * 8/1997 Davlantes ..... E06B 7/32 49/168
5,944,445 A * 8/1999 Montgomery ..... E04B 1/7076 405/87
6,165,066 A * 12/2000 Sharp ..... F24F 13/082 454/271
6,287,050 B1 * 9/2001 Montgomery ..... E02B 7/40 405/87
6,754,997 B2 * 6/2004 Bonin ..... E04C 2/521 52/198
7,270,498 B1 * 9/2007 Albanese ..... E04B 1/7076 405/103
7,600,944 B1 * 10/2009 Keating ..... E04H 9/145 405/101
7,913,454 B2 * 3/2011 Sullivan ..... E06B 7/32 160/180
2002/0000301 A1 * 1/2002 Rolin ..... E06B 9/52 160/330
2003/0102637 A1 * 6/2003 Hamel ..... E06B 9/00 277/630
2009/0148236 A1 * 6/2009 Achen ..... F24F 13/082 405/92
2009/0159220 A1 * 6/2009 Henning ..... E01F 7/025 160/330

* cited by examiner

INFLATABLE FLOOD BARRIER

BACKGROUND OF THE INVENTION

1. Technical Field

The present invention relates to flood protection devices, and more particularly to an inflatable flood barrier that is structurally simple, watertight, convenient to use and store, apparently pleasing, and functionally versatile.

2. Description of Related Art

At areas subject to floods, people often prepare flood barriers, so that when floods happen, these flood barriers can be mounted at house gates for preventing water invasion and consequent property damage.

FIG. 1 illustrates a conventional flood barrier that is in use. The conventional flood barrier 9 depicted is set at the house gate for blocking water from entering the house.

As shown in FIG. 1, the conventional flood barrier 9 has to be supported by a flood barrier frame 91 that is preinstalled along inner laterals of the house gate for the flood barrier 9 to slide in and get retained.

However, the conventional flood barrier 9 has its shortcomings, including that: (a) the flood barrier 9 needs to work with the flood barrier frame 91, and the contacting surfaces of the flood barrier 9 and the flood barrier frame 91 have to be precisely even, or the desired water-tightness is impossible; (b) the precisely even contacting surfaces as mentioned previously require time-consuming and energy-consuming processing; (c) after the flood barrier 9 slides into the flood barrier frame 91, a complicated pressing mechanism is required to make the flood barrier 9 and the flood barrier frame 91 stay close and provide water-tightness; (d) it is an inconvenience to preinstall the flood barrier frame 91 along the inner laterals of the house gate; (e) after the flood barrier frame 91 is installed as mentioned previously, it is fixed and becomes an unsightly hindrance when not in use; and (f) the flood barrier 9 has the sole usage of blocking water, so is functionally limited.

Hence, there is a need of a novel device that improves the shortcomings of the conventional flood barrier 9.

SUMMARY OF THE INVENTION

According to the present invention, an inflatable flood barrier comprises a board, at least one corner patch, at least one sealing block and a flexible seal.

Therein, the inflatable flood barrier features for: the board, comprising a side plate and a peripheral plate, the peripheral plate being attached to the side plate, the board being provided with a charging port, the peripheral plate comprising at least one rounded corner, the side plate comprising at least one corner portion, the at least one rounded corner and the at least one corner portion being positionally corresponding, and the at least one corner portion being provided with at least one guiding groove; the at least one corner patch, being positionally corresponding to the at least one corner portion and geometrically complementary to the at least one rounded corner, and the at least one corner patch being assembled to the peripheral plate; the at least one sealing block, adjoining the at least one rounded corner in a geometrically complementary manner and being sandwiched between the side plate and the at least one corner patch, the at least one sealing block sliding in the at least one guiding groove with at least one guiding member; and the flexible seal, embracing at least a part of the peripheral plate and comprising an internal channel, a gas inlet and a gas discharging port, the gas inlet and the gas discharging port being in gaseous communication with the internal channel, and the gas inlet being in gaseous communication with the charging port.

With the configuration described previously, the disclosed inflatable flood barrier that is structurally simple, watertight, convenient to use and store, apparently pleasing, and functionally versatile.

Briefly, the disclosed inflatable flood barrier has many benefits, including that: (a) the desired water-tightness is achieved without using any frames; (b) the installation is convenient since there is no flood barrier frame to be installed in advance; (c) the flexible seal when inflated can perfectly fit any surfaces it contacts, even uneven ones; (d) with the flexible seal, the desired water-tightness is achieved without using any complicated pressing mechanism; (e) the inflatable flood barrier can also act as a safety fence for protecting children or pets; (f) the inflatable flood barrier can be removed when not in use and leave the gate open and accessible without hindrance; and (g) when not in use, it can be easily stored or displayed as a wall-mounted decoration.

The aforementioned side plate has at least one rib.

The aforementioned charging port is formed on the peripheral plate.

The aforementioned board has an accommodating space.

The aforementioned inflatable flood barrier further comprises at least one gas tank that is received in the accommodating space.

The aforementioned board has a gripping opening.

The aforementioned inflatable flood barrier further comprises a pressure gauge that is mounted on the peripheral plate and in gaseous communication with the internal channel.

The aforementioned inflatable flood barrier further comprises a cap that covers the charging port.

The aforementioned inflatable flood barrier further comprises at least one veneer that is assembled to the peripheral plate.

DETAILED DESCRIPTION OF THE INVENTION

Figure 1:
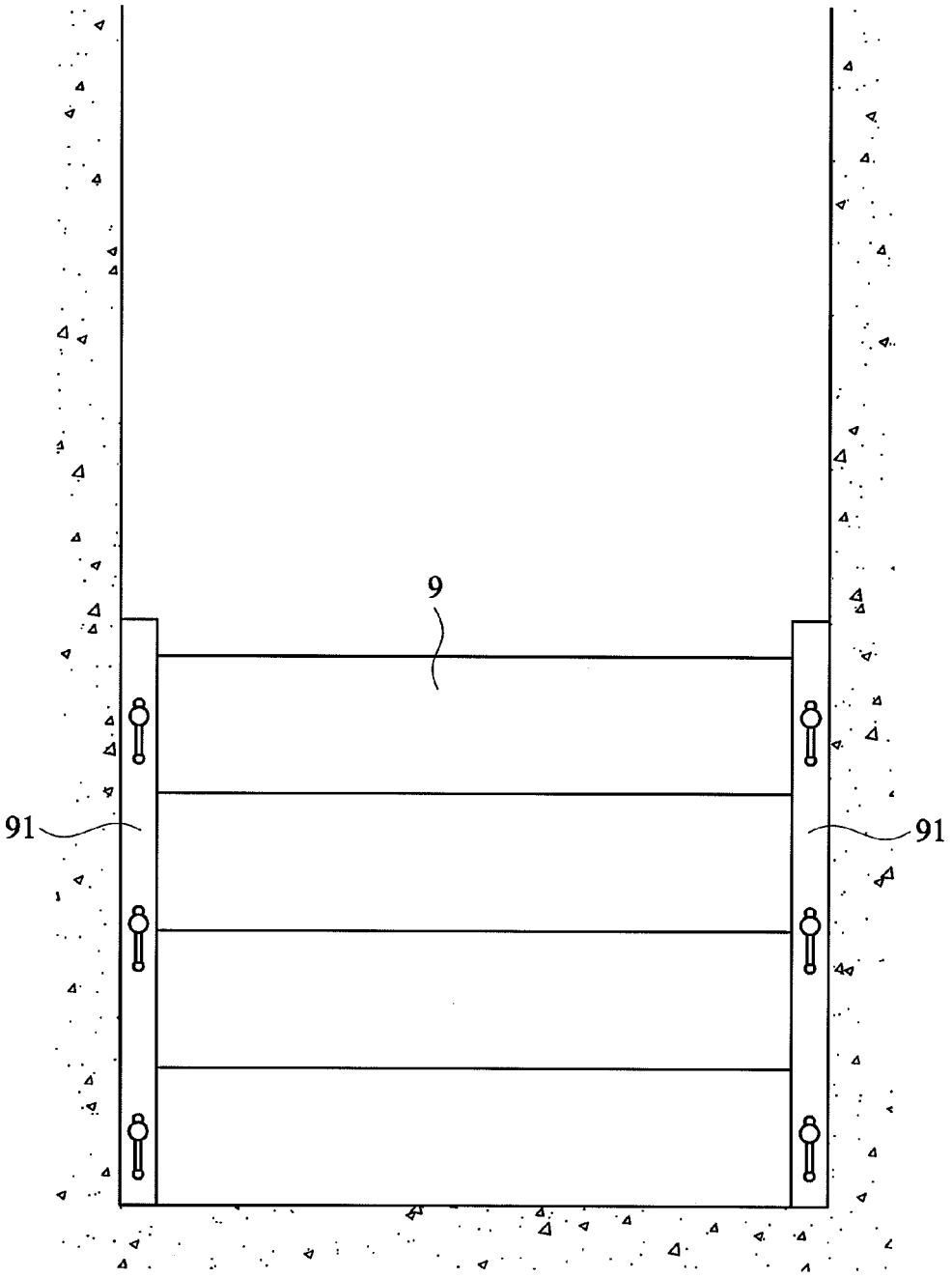
FIG. 1(Prior Art)
FIG. 1 illustrates a conventional flood barrier in use.
Figure 2:
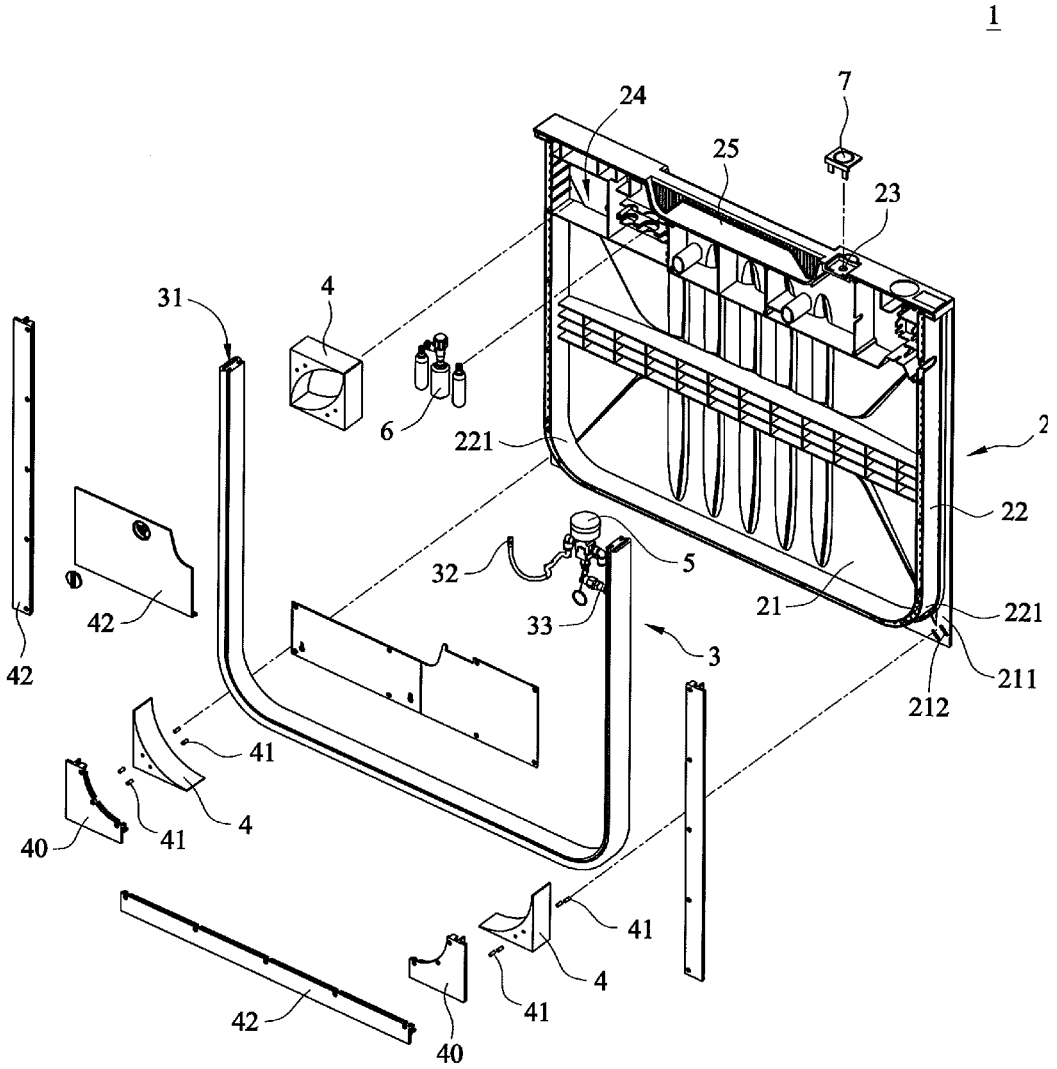
FIG. 2 is an exploded view of a first preferred embodiment of the present invention.
Figure 3:
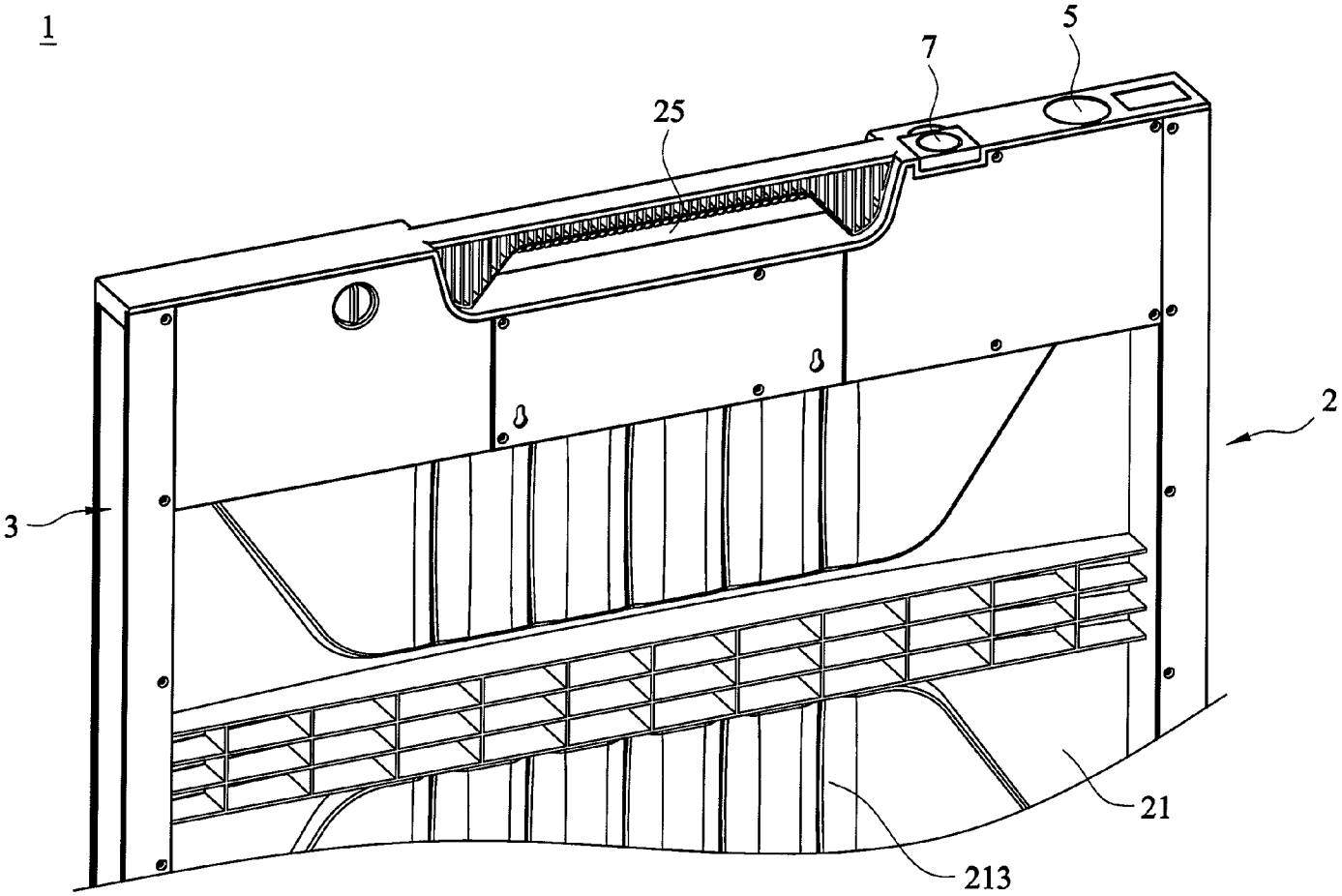
FIG. 3 is a schematic perspective view of the first preferred embodiment of the present invention.

Please refer to FIG. 2 together with FIG. 3, which are an exploded view and a partial perspective view of a first preferred embodiment of the present invention. Therein, an inflatable flood barrier 1 comprises a board 2 and a flexible seal 3.

As shown, the board 2 comprises a side plate 21 and a peripheral plate 22. The peripheral plate 22 is attached to the side plate 21. The board 2 is provided with a charging port 23. The flexible seal 3 at least embraces a part of the peripheral plate 22. The flexible seal 3 comprises an internal channel 31, a gas inlet 32 and a gas discharging port 33. The gas inlet 32 and the gas discharging port 33 are in gaseous communication with the internal channel 31, and the gas inlet 32 is in gaseous communication with the charging port 23 when assembled together.

In the present embodiment, the flexible seal 3 has a U-like shape and embraces the peripheral plate 22 at its lower and two lateral edges. Of course, the flexible seal 3 may be alternative formed as an O-like member and embrace the upper, lower, left and right edges of the peripheral plate 22. Yet alternatively, the flexible seal 3 may embrace the peripheral plate 22 at a small part of its upper edge in addition to the lower and two lateral edges of the peripheral plate 22 as described previously.

As shown in FIG. 2, the peripheral plate 22 comprises at least one rounded corner 221. The side plate 21 comprises at least one corner portion 211 that is positionally corresponding to the at least one rounded corner 221. Moreover, there is at least one corner patch 40 that is positionally corresponding to the at least one corner portion 211 and is geometrically complementary to the at least one rounded corner 221. The at least one corner patch 40 is configured to be assembled to the peripheral plate 22. There is further at least one sealing block 4 that adjoins the at least one rounded corner 221 in a geometrically complementary manner and get sandwiched between the side plate 21 and the at least one corner patch 40.

Particularly, in the present embodiment, the peripheral plate 22 has two rounded corners 221 at its lower part, and the side plate 21 has two corner portions 211 at its lower part. The two corner portions 211 and the two rounded corners 221 are positionally corresponding to each other. Additionally, as shown in FIG. 2, there are two corner patches 40 and two sealing blocks 4. The two sealing blocks 4 are slidably attached to the corner portions 211 and adjoin the rounded corners 221 in a geometrically complementary manner, respectively. In other words, each said sealing block 4 is has a shape complementary to the shape of the corresponding rounded corner 221. The two sealing blocks 4 are sandwiched between the side plate 21 and the corner patches 40.

Figure 4:
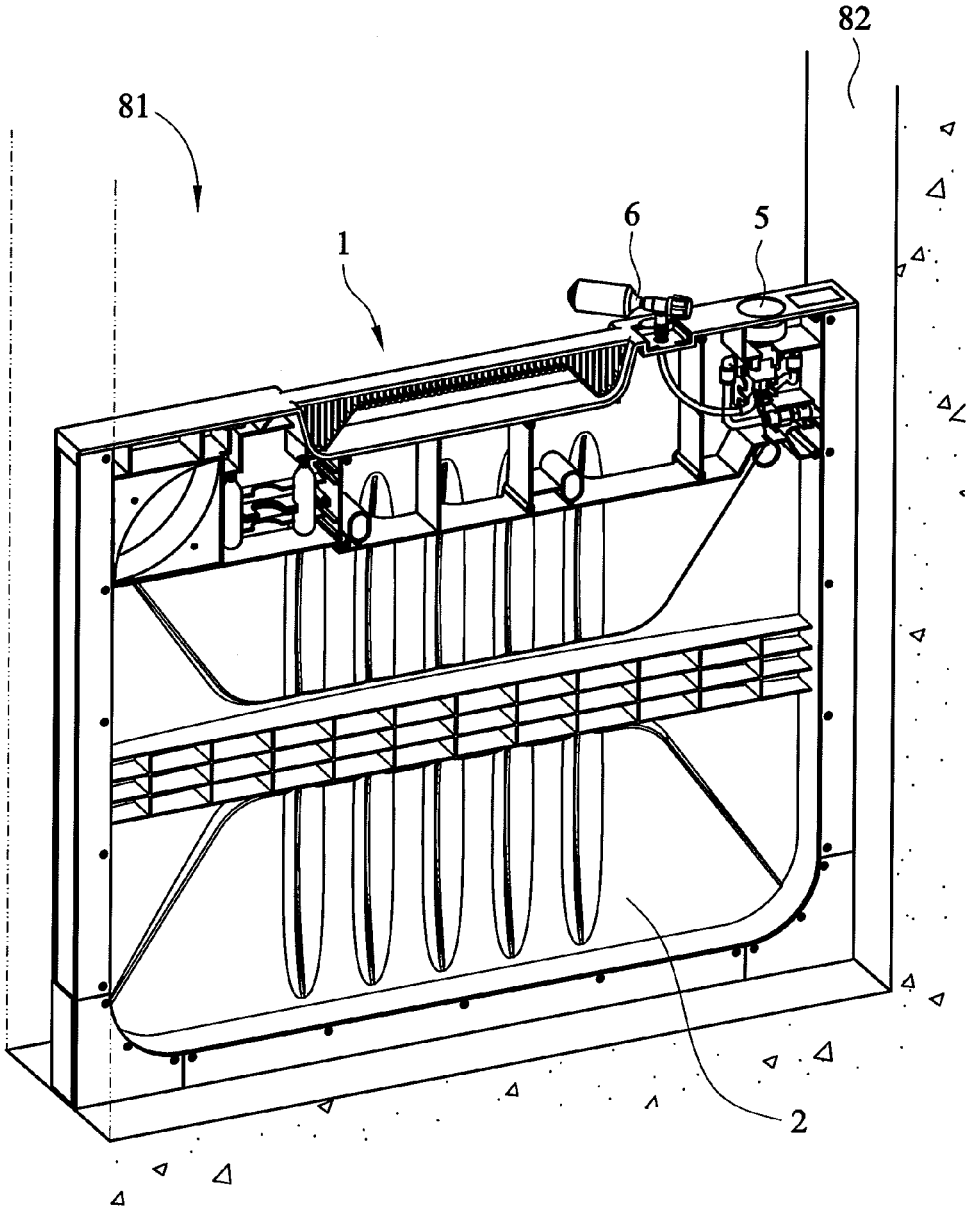
FIG. 4 depicts the first preferred embodiment of the present invention in use.
Figure 5:
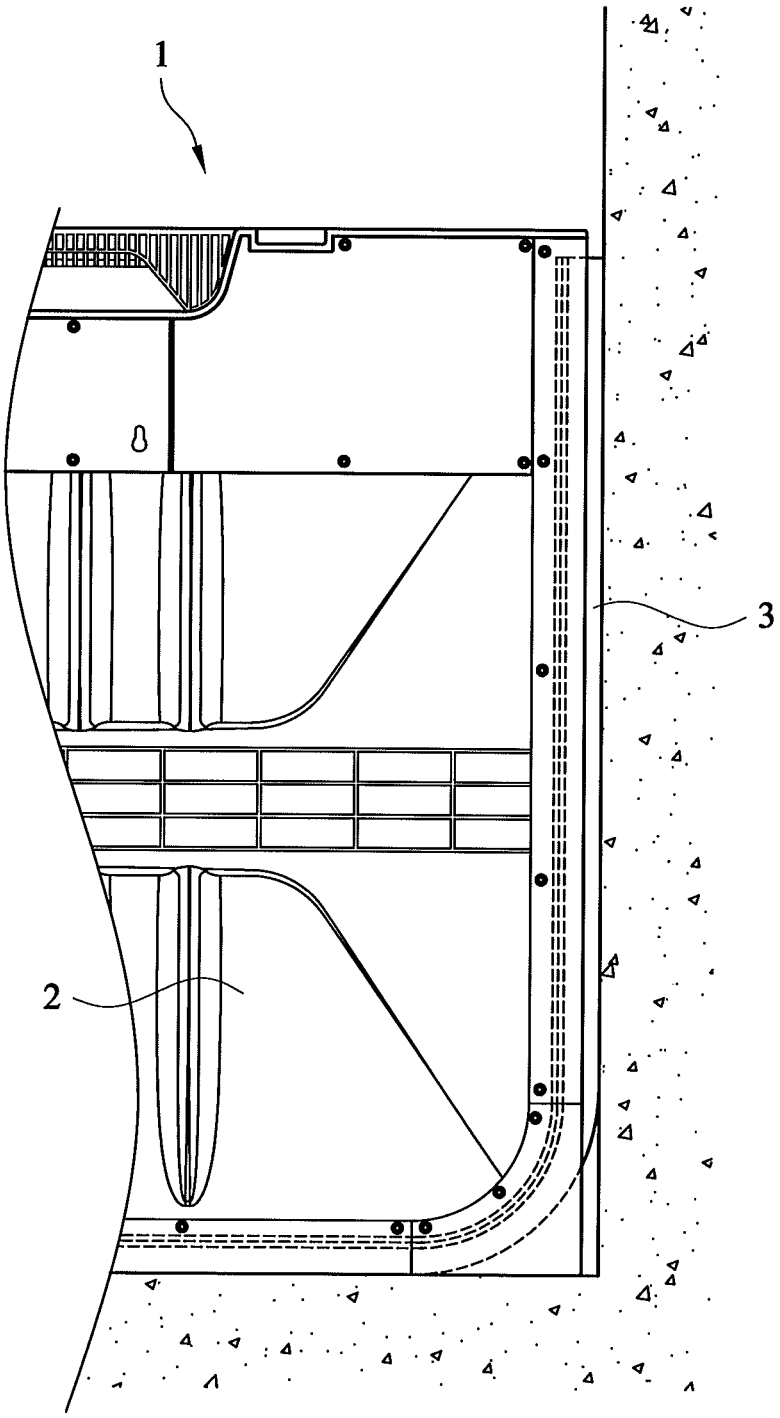
FIG. 5 shows the first preferred embodiment of the present invention having its flexible seal inflated to expansion.

Please refer to FIG. 4 and FIG. 5. FIG. 4 depicts the first preferred embodiment of the present invention in use. FIG. 5 shows the first preferred embodiment of the present invention having its flexible seal inflated to expansion. Please also refer back to FIG. 2 for the following description.

In use, such as in the event of cataracts of rain flooding the streets, the inflatable flood barrier 1 can be installed at a house gate 81, and infused with gas through the charging port 23 of the board 2 so that the gas enters the internal channel 31 of the flexible seal 3 and makes the flexible seal 3 expand. At this time, the expanded flexible seal 3 can fittingly press against the wall 82 of the gate 81, thereby forming a watertight combination that blocks the flood from entering the house gate 81.

As shown, in the present embodiment, a gas tank 6 is used for said inflation. Other means, of course, may be implemented for inflation, such as a manual pump.

By inflating the flexible seal 3, the watertight combination can be achieved by mutual pressing between the components, as described previously. In other word, instead of any structurally complicated pressing mechanisms, the simple configuration of the present invention is effective in providing water-tightness. Besides, the disclosed device eliminates the use of a frame as one mentioned in the previous discussion about the prior art, and its installation requires no tools, making its use quick and convenient. Moreover, even if the wall 82 has an uneven contacting surface, the inflated flexible seal 3 can perfectly fit, thereby ensuring the desired water-tightness.

When not in use, the inflatable flood barrier 1 can be easily removed and stored. Since it is only installed when needed, in normal days the house gate 81 is left open and accessible without unnecessary hindrance.

Referring to FIG. 2 and FIG. 4, when in use, the flexible seal 3 after inflated can abuts against the sealing blocks 4 and pushing the sealing blocks 4 to slide. With this configuration, the flexible seal 3 and the sealing blocks 4 work together to perfectly fit the contacting surface of the wall 82, thereby ensuring water-tightness.

The sliding of the sealing block 4 as referred to in the present embodiment may be achieved by the following means. Each of the corner portions 211 is provided with a plurality of guiding groove 212 (in an arbitrary amount), and each of the sealing blocks 4 slides along the guiding grooves 212 with its corresponding guiding members 41 (in an arbitrary amount). The guiding members 41 may be bolts.

Moreover, the side plate 21 is provided with at least one rib 213. As shown in FIG. 2 and FIG. 3, there are plural ribs 213. Theses structural features serve to not only enhance the impact strength of the inflatable flood barrier 1, but also cancel out the impact from streams and wares.

Additionally, in the present embodiment, the charging port 23 is formed on the peripheral plate 22, while it can be alternatively formed otherwise according to practical needs. Also, in the present embodiment, a cap 7 may be provided to cover the charging port 23 whenever not during inflation, so as to prevent contaminations and other foreign articles from entering the charging port 23.

Furthermore, a pressure gauge 5 may be mounted on the peripheral plate 22 and in gaseous communication with the internal channel 31 for monitoring the gas pressure in the flexible seal 3.

Also, in the present embodiment, plural veneers 42 (in an arbitrary amount) in shapes of, for example, narrow rectangle and rectangle, may be assembled to the peripheral plate 22, for endowing the inflatable flood barrier 1 with eye-pleasing appearance.

In FIG. 4, a gas tank 6 is used for inflation. More said gas tanks 6 may be prepared and stored in the inflatable flood barrier 1 for convenient use.

Figure 6:
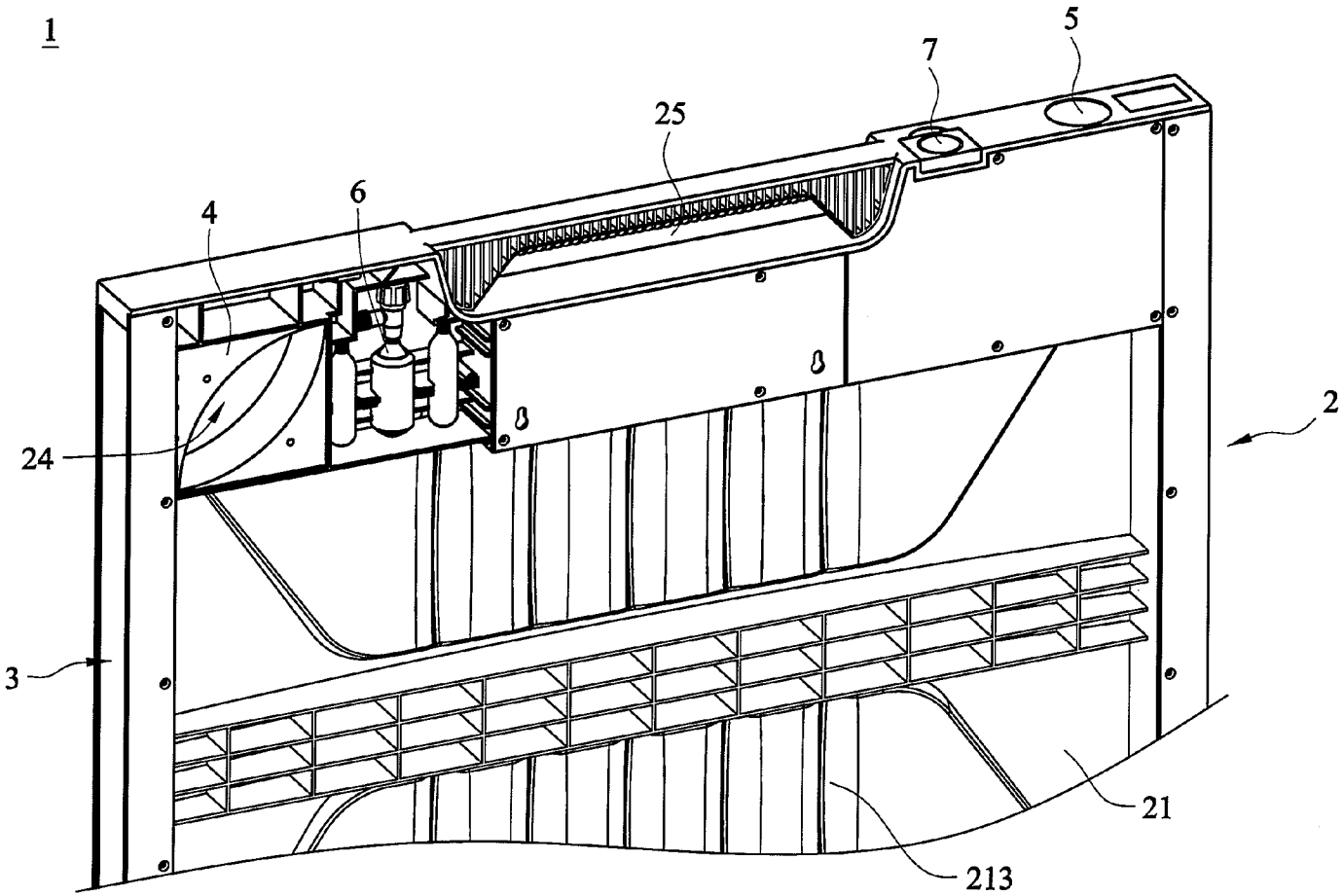
FIG. 6 is a schematic drawing showing the first preferred embodiment of the present invention stored in reserve.

Referring to FIG. 6, the first preferred embodiment of the present invention is now stored in reserve. As shown, the board 2 further comprises an accommodating space 24 for receiving one or more said gas tanks 6. Spare sealing blocks 4 may be also stored therein. A rectangular veneer 42 may be provided for closing the accommodating space 24.

As shown in FIG. 3, the board 2 is further provided with a gripping opening 25 so as to form a handle-like structure for the user to hold and handle the inflatable flood barrier 1.

Figure 7:
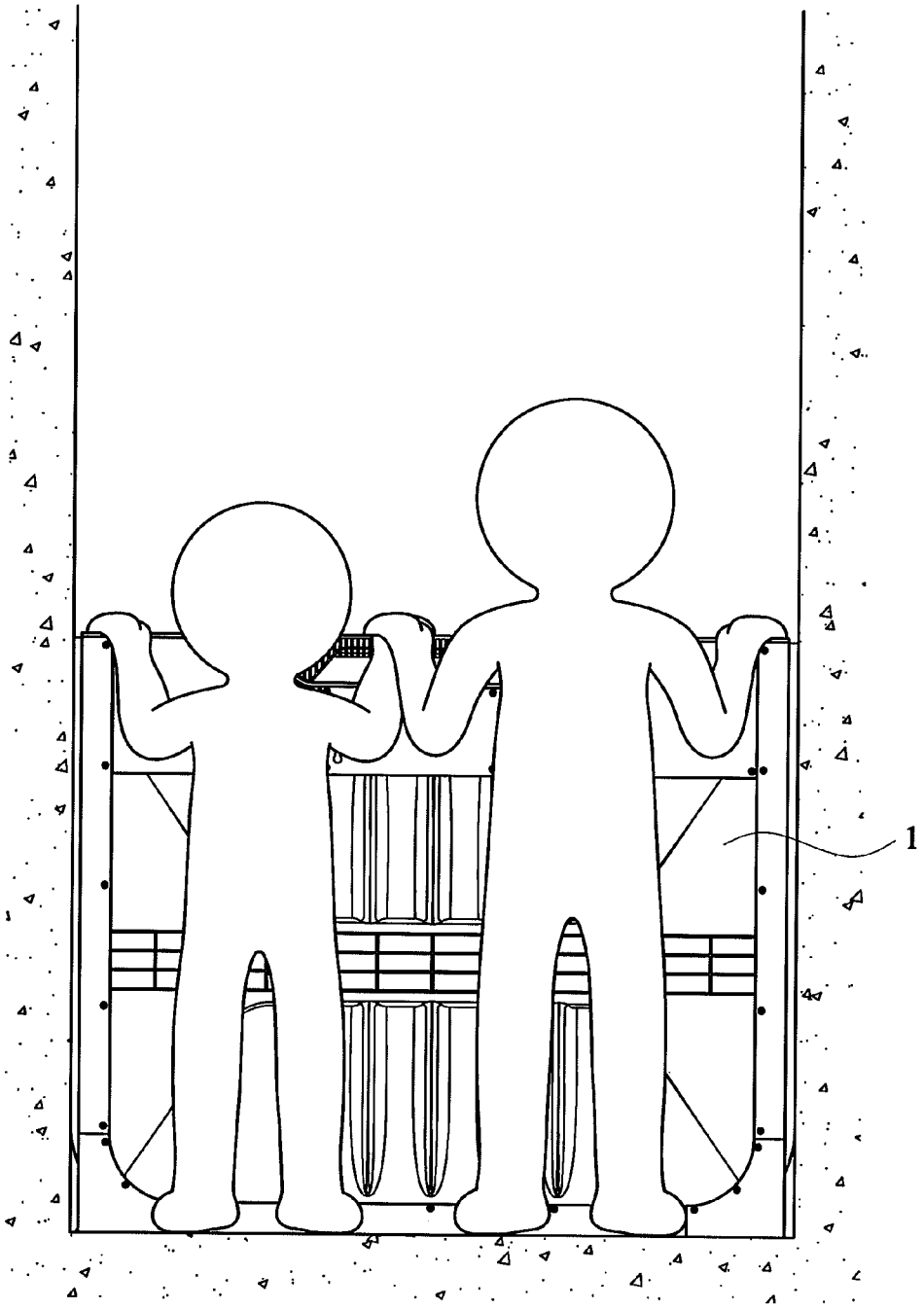
FIG. 7 illustrates a second preferred embodiment of the present invention in use.

Referring to FIG. 7, a second preferred embodiment of the present invention in use is shown. The inflatable flood barrier 1 may be used as a safety fence for children or pets. This allows the disclosed inflatable flood barrier 1 to be versatile.

Figure 8:
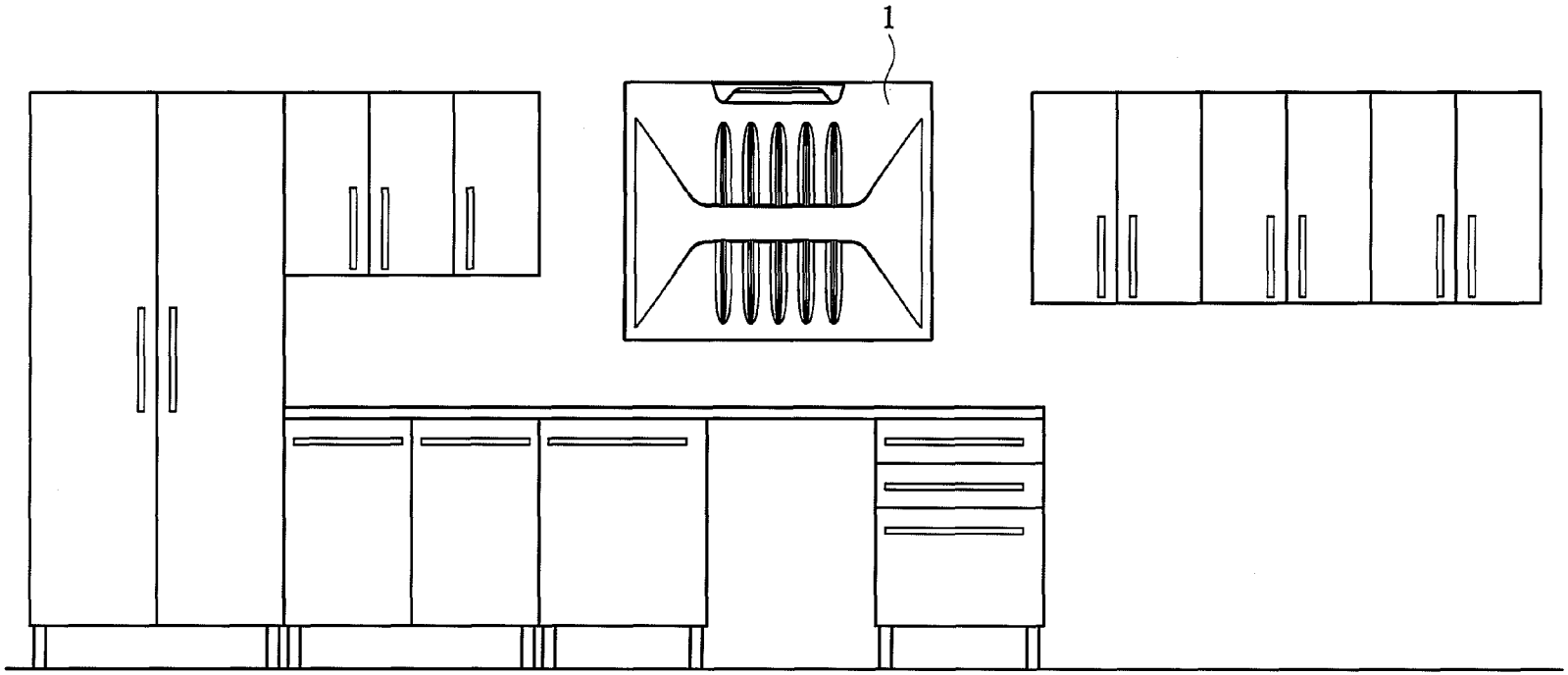
FIG. 8 depicts a third preferred embodiment of the present invention in use.

FIG. 8 depicts a third preferred embodiment of the present invention in use. As shown, the inflatable flood barrier 1 when not used for blocking floods can be simply stored, or displayed as a wall-mounted decoration as it is beautified by the veneers 42.

The present invention has been described with reference to the preferred embodiments and it is understood that the embodiments are not intended to limit the scope of the present invention. Moreover, as the contents disclosed herein should be readily understood and can be implemented by a person skilled in the art, all equivalent changes or modifications which do not depart from the concept of the present invention should be encompassed by the appended claims.

What is claimed is:

1. An inflatable flood barrier, comprising:

a board, comprising a side plate and a peripheral plate, the peripheral plate being attached to the side plate, the board being provided with a charging port, the peripheral plate comprising at least one rounded corner, the side plate comprising at least one corner portion, the at least one rounded corner and the at least one corner portion being positionally corresponding, and the at least one corner portion being provided with at least one guiding groove;

at least one corner patch, being positionally corresponding to the at least one corner portion and geometrically complementary to the at least one rounded corner, and the at least one corner patch being assembled to the peripheral plate;

at least one sealing block, adjoining the at least one rounded corner in a geometrically complementary manner and being sandwiched between the side plate and the at least one corner patch, the at least one sealing block including at least one guiding member inserting to the at least one guiding groove, the at least one sealing block sliding along the at least one guiding groove with the at least one guiding member; and a flexible seal, embracing at least a part of the peripheral plate and comprising an internal channel, a gas inlet and a gas discharging port, the gas inlet and the gas discharging port being in gaseous communication with the internal channel, and the gas inlet being in gaseous communication with the charging port.

2. The inflatable flood barrier of claim 1, wherein the side plate is provided with at least one rib.

3. The inflatable flood barrier of claim 1, wherein the charging port is provided on the peripheral plate.

4. The inflatable flood barrier of claim 1, wherein the board has an accommodating space.

5. The inflatable flood barrier of claim 4, further comprising at least one gas tank that is received in the accommodating space.

6. The inflatable flood barrier of claim 1, wherein the board is provided with a gripping opening.

7. The inflatable flood barrier of claim 1, further comprising a pressure gauge that is mounted on the peripheral plate and in gaseous communication with the internal channel.

8. The inflatable flood barrier of claim 1, further comprising a cap that covers the charging port.

9. The inflatable flood barrier of claim 1, further comprising at least one veneer that is assembled to the peripheral plate.

10. The inflatable flood barrier of claim 1, wherein the at least one corner portion includes a plurality of guiding grooves which are mutually arranged in parallel, and the at least one sealing block includes a plurality of guiding members.

* * * * *